US006199881B1

(12) United States Patent
Wood et al.

(10) Patent No.: US 6,199,881 B1
(45) Date of Patent: Mar. 13, 2001

(54) SKATEBOARD STIRRUP

(76) Inventors: Candace Wood; Dean Morrissey, both of 1061 Green Point Ct., Concord, CA (US) 94521

( * ) Notice: Subject to any disclaimer, the term of this patent is extended or adjusted under 35 U.S.C. 154(b) by 0 days.

(21) Appl. No.: 09/348,949

(22) Filed: Jul. 7, 1999

(51) Int. Cl.[7] ..... B62M 1/00

(52) U.S. Cl. ..... 280/87.042; 280/87.041; 280/814; 441/70; 441/74; 441/75

(58) Field of Search ..... 280/87.041, 87.042, 280/615, 814–16; 441/75, 74, 70

(56) References Cited

U.S. PATENT DOCUMENTS

| | | | | |
|---|---|---|---|---|
| 3,593,356 | * | 7/1971 | Schmalfeldt | 441/74 |
| 4,135,726 | | 1/1979 | Beaver . | |
| 4,221,394 | * | 9/1980 | Campbell | 280/14.2 |
| 4,586,451 | * | 5/1986 | Mori | 114/219 |
| 4,604,070 | * | 8/1986 | McKee et al. | 441/70 |
| 4,915,400 | * | 4/1990 | Chambers | 280/14.2 |
| 4,955,314 | * | 9/1990 | Skedeleski et al. | 114/219 |
| 4,990,113 | * | 2/1991 | Morrison | 441/75 |
| 5,005,868 | * | 4/1991 | Stern et al. | 280/814 |
| 5,020,827 | * | 6/1991 | Murdoch | 280/816 |
| 5,167,553 | * | 12/1992 | Wilson | 441/75 |
| 5,195,781 | * | 3/1993 | Osawa | 280/842 |
| 5,310,221 | * | 5/1994 | Schmidt | 280/809 |
| 5,362,270 | * | 11/1994 | Hanson et al. | 441/75 |

FOREIGN PATENT DOCUMENTS

2635693 * 8/1988 (FR) .

* cited by examiner

*Primary Examiner*—Brian L. Johnson
*Assistant Examiner*—Deanna Draper
(74) *Attorney, Agent, or Firm*—Jack Lo

(57) ABSTRACT

A skateboard stirrup is comprised of a pair of hollow end caps for cupping over the front and rear ends of a skateboard, and a resilient band connected between the end caps. When the rider's feet are on top of the band, it is yielding enough to allow the feet to make full contact with the top of the board. When the rider's feet are inserted under the band, it is taut enough to lift the skateboard for airborne maneuvers when the feet are lifted.

9 Claims, 1 Drawing Sheet

SKATEBOARD STIRRUP

BACKGROUND OF THE INVENTION

1. Field of the Invention

This invention relates generally to skateboards.

2. Prior Art

A conventional skateboard is comprised of an elongated board with a pair of front wheels and a pair of rear wheels. In addition to rolling along the ground and making turns, skillful skateboard riders can make complex maneuvers with a board. Many maneuvers involve jumping or lifting the board off the ground. A rider can either lift it by hand, or step on its rear end to pitch up the front end. These methods are difficult to master, and are limiting in the type of maneuvers they enable a rider to perform. Although U.S. Pat. No. 4,135,726 to Beaver shows a skateboard with a handrail which may be used to lift the skateboard, the handrail is tall and rigid, so that the rider's freedom of movement is severely restricted by it.

OBJECTS OF THE INVENTION

Accordingly, objects of the present skateboard stirrup are:

to allow a rider to easily lift a skateboard for airborne maneuvers;

to allow a rider to stand on the skateboard in a conventional fashion;

to not limit a rider's freedom of movement; and to be easily retrofitted to a conventional skateboard.

Further objects of the present invention will become apparent from a consideration of the drawings and ensuing description.

BRIEF SUMMARY OF THE INVENTION

A skateboard stirrup is comprised of a pair of hollow end caps for cupping over the front and rear ends of a skateboard, and a resilient band connected between the end caps. When the rider's feet are on top of the band, it is yielding enough to allow the feet to make full contact with the top of the board. When the rider's feet are inserted under the band, it is taut enough to lift the skateboard for airborne maneuvers when the feet are lifted.

DRAWING REFERENCE NUMERALS

| | | | |
|---|---|---|---|
| 10. | End Cap | 11. | End Cap |
| 12. | Resilient Band | 13. | Top Portion |
| 14. | Top Portion | 15. | Bottom Portion |
| 16. | Bottom Portion | 17. | Edge Portion |
| 18. | Edge Portion | 19. | Bumper |
| 20. | Bumper | 21. | Front End of Skateboard |
| 22. | Rear End of Skateboard | 23. | Skateboard |

DETAILED DESCRIPTION OF THE INVENTION

Figure 1:
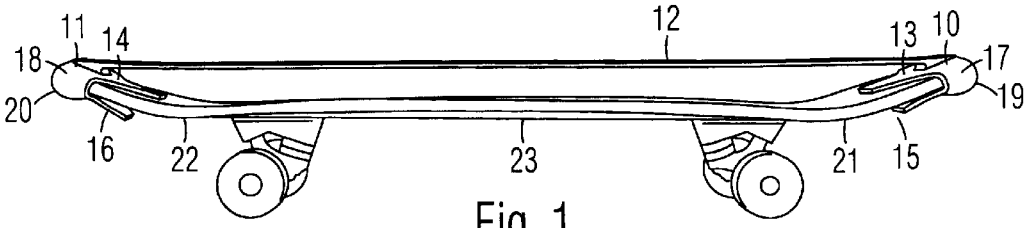
FIG. 1 is a side view of the present skateboard stirrup attached to a conventional skateboard.

A preferred embodiment of the present skateboard stirrup is shown in a side view in FIG. 1. It is comprised of a pair of hollow end caps 10 and 11 connected at their far ends by a resilient band 12. End caps 10 and 11 respectively include top portions 13 and 14 connected in spaced relation to bottom portions 15 and 16 by edge portions 17 and 18. End caps 11 are also provided with thickened portions or bumpers 19 and 20 projecting forward and down from bottom portions 15 and 16. The entire stirrup, or at least band 12, is preferably made of "90 DURO POLYURETHANE RLA UE-906A", or another suitable material with a predetermined amount of elasticity. End caps 10 and 11 are for being cupped over front and rear upturned ends 21 and 22 of a conventional skateboard 23. Since most conventional skateboards are made in a single standard size, end caps 10 and 11, and band 12 are sized accordingly to fit them. Band 12 is preferably narrower than end caps 10 and 11, and much narrower than skateboard 23.

Figure 2:
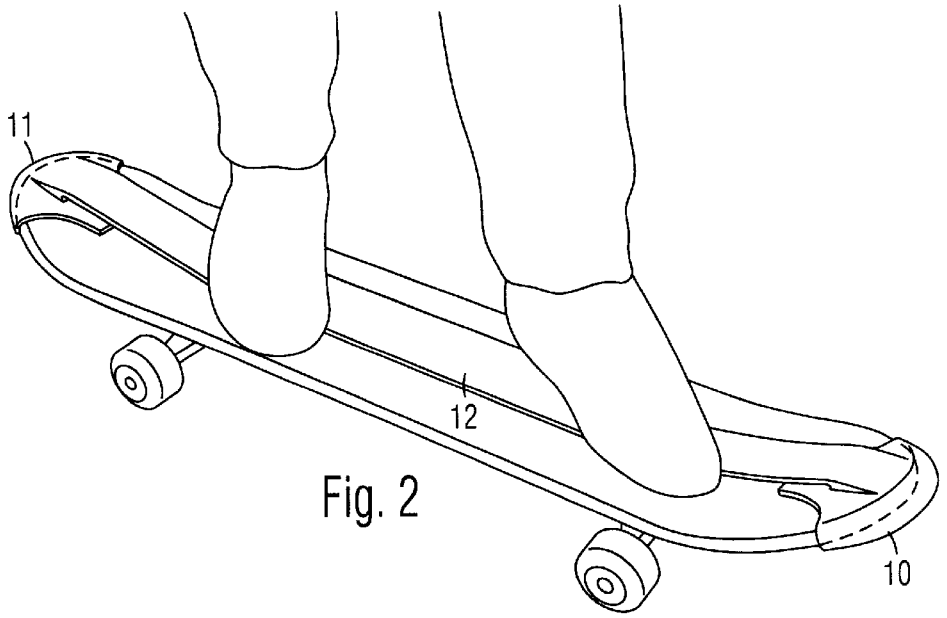
FIG. 2 is a top perspective view of the stirrup when a rider's feet are on top of it.
Figure 3:
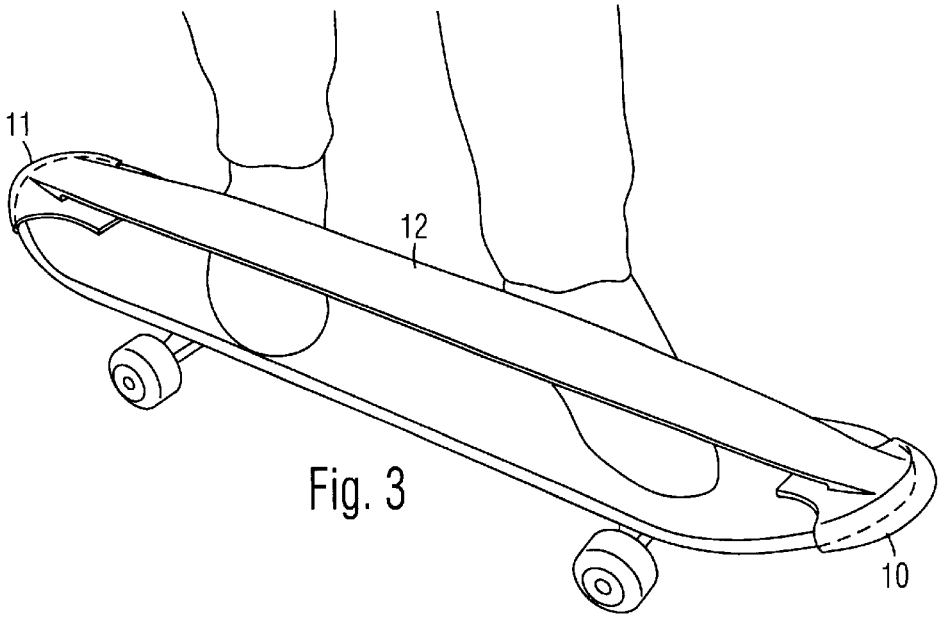
FIG. 3 is a top perspective view of the stirrup when the rider's feet are inserted under it.

As shown in FIG. 2, when the rider's feet are on top of band 12, it is yielding enough to allow the feet to make full contact with the top of skateboard 23, and not restrict the rider's freedom of movement. Band 12 is connected to the far or upper ends of end caps 10 and 11, so that it is spaced far enough from the top of skateboard 23 to allow the rider's feet to easily slip under it. Band 12 is also narrow enough to allow the feet to easily slip under or pull out from under it. When the rider's feet are inserted under band 12, it is taut enough to lift the skateboard reliably for airborne maneuvers when the feet are lifted. End caps 10 and 11 are protected by bumpers 19 and 20 when skateboard 23 is tilted and one end thereof is rubbing along the ground.

SUMMARY AND SCOPE

Accordingly, the present skateboard stirrup allows a rider to easily lift a skateboard for airborne maneuvers. It allows a rider to stand on the skateboard in a conventional fashion. It does not limit a rider's freedom of movement. It is also easily retrofitted to a conventional skateboard.

Although the above description is specific, it should not be considered as a limitation on the scope of the invention, but only as an example of the preferred embodiment. Many variations are possible within the teachings of the invention. Therefore, the scope of the invention should be determined by the appended claims and their legal equivalents, not by the examples given.

What is claimed is:

1. A skateboard apparatus, comprising:

a skateboard with an upturned front end and an upturned rear end; and a resilient band attached between said upturned front end and said upturned rear end, and spaced from a top surface of said skateboard enough to enable a rider's feet to easily slip under said resilient band, said resilient band having a predetermined elasticity for yielding enough to engage said top surface of said skateboard when said feet are on top of said resilient band, said resilient band having a predetermined tautness for lifting said skateboard when said feet are inserted between said resilient band and said top surface of said skateboard and when said feet are lifted;

wherein said resilient band is connected in a generally straight line between said upturned front end and said upturned rear end of said skateboard for enabling said feet to slip under said resilient band anywhere along said skateboard for greater flexibility in use.

2. The skateboard stirrup of claim 1, wherein said resilient band is comprised of a polyurethane which provides said elasticity and said tautness.

3. The skateboard stirrup of claim 1, wherein said resilient band is narrower than said end caps, and thus for being narrower than said skateboard for enabling said feet to slip in and out easily.

4. A skateboard stirrup, comprising:

a pair of hollow end caps for cupping over opposite upturned ends of a skateboard, wherein said hollow end caps are adapted to be easily retrofitted by a user to a preexisting skateboard; and a resilient band attached between said hollow end caps, said resilient band for being spaced from a top surface of said skateboard for enabling a rider's feet to easily slip under said resilient band, said resilient band having a predetermined elasticity for yielding enough to engage said top surface of said skateboard when said feet are on top of said resilient band, said resilient band having a predetermined tautness for lifting said skateboard when said feet are inserted between said resilient band and said top surface of said skateboard and when said feet are lifted;

wherein said resilient band is adapted to be connected in a generally straight line between said upturned front end and said upturned rear end of said skateboard for enabling said feet to slip under said resilient band anywhere along said skateboard for greater flexibility in use.

5. The skateboard stirrup of claim 4, further including a pair of bumpers projecting down from corresponding end caps for providing protection from scrapes against the ground.

6. The skateboard stirrup of claim 4, wherein said resilient band is narrower than said end caps, and thus for being narrower than said skateboard for enabling said feet to slip in and out easily.

7. A skateboard stirrup, comprising:

a pair of hollow end caps for cupping over opposite upturned ends of a skateboard, each of said hollow end caps comprising a top portion and a bottom portion connected in spaced relation by an edge portion, wherein said hollow end caps are adapted to be easily retrofitted by a user to a pre-existing skateboard; and a resilient band attached between said hollow end caps, said resilient band for being spaced from a top surface of said skateboard for enabling a rider's feet to easily slip under said resilient band, said resilient band having a predetermined elasticity for yielding enough to engage said top surface of said skateboard when a pair of feet are on top of said resilient band, said resilient band having a predetermined tautness for lifting said skateboard when said feet are inserted between said resilient band and said top surface of said skateboard and when said feet are lifted;

wherein said resilient band is adapted to be connected in a generally straight line between said upturned front end and said upturned rear end of said skateboard for enabling said feet to slide under said resilient band anywhere along said skateboard for greater flexibility in use.

8. The skateboard stirrup of claim 7, wherein said resilient band is comprised of a polyurethane which provides said elasticity and said tautness.

9. The skateboard stirrup of claim 7, wherein said resilient band is narrower than said end caps, and thus for being narrower than said skateboard for enabling said feet to slip in and out easily.

* * * * *